US009719718B2

(12) United States Patent
Piendl et al.

(10) Patent No.: US 9,719,718 B2
(45) Date of Patent: Aug. 1, 2017

(54) CASING FOR A DEVICE THAT CAN BE USED IN DOMESTIC, CATERING, OR RETAIL SECTORS

(75) Inventors: Harald Piendl, Salzburg (AT); Eike Schaefer, Anger (DE); Rainer Vogt, Bad Reichenhall (DE); Peder Madsen, Esbjerg V (DK); Kenneth Tønder, Esbjerg V (DK)

(73) Assignee: Red Bull GmbH, Fuschl am See (AT)

( * ) Notice: Subject to any disclaimer, the term of this patent is extended or adjusted under 35 U.S.C. 154(b) by 830 days.

(21) Appl. No.: 13/981,905

(22) PCT Filed: Jan. 25, 2012

(86) PCT No.: PCT/EP2012/000321

§ 371 (c)(1),
(2), (4) Date: Jan. 8, 2014

(87) PCT Pub. No.: WO2012/104030

PCT Pub. Date: Aug. 9, 2012

(65) Prior Publication Data

US 2014/0110414 A1 Apr. 24, 2014

(30) Foreign Application Priority Data

Feb. 2, 2011 (EP) ..... 11450016

(51) Int. Cl.
*B65D 6/10* (2006.01)
*F25D 23/06* (2006.01)
(Continued)

(52) U.S. Cl.
CPC ..... *F25D 23/063* (2013.01); *F25D 23/065* (2013.01); *A47B 2096/208* (2013.01); *F25D 2400/18* (2013.01)

(58) Field of Classification Search
CPC .... F25D 11/00; F25D 23/02; F25D 23/23063; F25D 2323/06; F25D 23/08;
(Continued)

(56) References Cited

U.S. PATENT DOCUMENTS 4,006,947 A * 2/1977 Haag ..... B65D 81/3823 220/592.1
4,040,166 A * 8/1977 Morphy ..... F25D 23/064 220/592.1
(Continued)

FOREIGN PATENT DOCUMENTS

DE 20 03 727 9/1970
DE 10 2005 002 147 A1 7/2006
(Continued)

OTHER PUBLICATIONS

Japanese Office Action dated Nov. 11, 2014, for corresponding JP Application No. 2013-552127, 4 pages.
(Continued)

*Primary Examiner* — J. Gregory Pickett
*Assistant Examiner* — Niki M Eloshway
(74) *Attorney, Agent, or Firm* — Seed IP Law Group LLP

(57) ABSTRACT

A casing for a device that can be used in the domestic, catering, or retail sectors, in one embodiment a refrigerating device, that has two lateral walls, a top wall, and a rear wall. The casing comprises two lateral casing elements for covering the lateral walls of the device, a top casing element for covering the top wall of the device, and a rear casing element for covering the rear wall of the device. The lateral casing elements and the top casing element each have an angled front edge section for engaging around a front edge of the lateral walls and a front edge of the top wall, respectively. Each lateral casing element includes a retaining profile on a
(Continued)

face opposite the angled front edge section, the rear casing element being held in said retaining profiles.

24 Claims, 17 Drawing Sheets

(51) Int. Cl.
*F25D 23/00* (2006.01)
*A47B 96/20* (2006.01)

(58) Field of Classification Search
CPC .. F25D 2400/18; F25D 23/065; F25D 23/063; A47B 2096/208
USPC ..... 220/592.02, 23.91, 682
See application file for complete search history.

(56) References Cited

U.S. PATENT DOCUMENTS 5,941,624 A * 8/1999 Pfeffer ..... B29C 44/12 312/405.1
6,067,738 A * 5/2000 Zeligson ..... F25D 23/02 40/600
2005/0092006 A1* 5/2005 Dresser ..... A47F 3/004 62/249
2007/0216270 A1* 9/2007 Betto ..... F25D 23/063 312/404
2008/0024047 A1* 1/2008 Juo ..... A47F 3/043 312/405
2008/0047209 A1* 2/2008 Hinterholzer ..... A47F 3/0434 52/208
2012/0061405 A1* 3/2012 Kwon ..... F25D 23/028 220/592.02
2012/0104909 A1* 5/2012 Kaplan ..... F25D 23/02 312/204
2012/0145662 A1* 6/2012 Geng ..... F16B 5/07 211/175

FOREIGN PATENT DOCUMENTS

JP 45-22919 Y 9/1970
JP 46-12261 Y 4/1971
JP 60-167994 U 11/1985
JP 2000-146422 A 5/2000
JP 2003-130542 A 5/2003

OTHER PUBLICATIONS

International Search Report dated May 29, 2012, in International Patent Application No. PCT/EP2012/000321, filed Jan. 25, 2012, 4 pages.

* cited by examiner

CASING FOR A DEVICE THAT CAN BE USED IN DOMESTIC, CATERING, OR RETAIL SECTORS

FIELD

The present disclosure relates to a casing for a device that can be used in the domestic, catering, or retail sector, such as a refrigerating device that has two lateral walls, a top wall, and a rear wall.

BACKGROUND

Casings for devices that can be used in the domestic, catering, or retail sector, such as refrigerating devices, have become known in various designs. For example, panels have become known that can be inserted in or clipped on frames or similar retaining devices specifically provided for said panels. This means that the respective device must be equipped with a suitable frame or retaining device. Further, casing elements have become known that can be screwed on lateral walls or on the door of the device. However, this has a disadvantage that the device must have bores provided with a suitable screw thread for this purpose and that the assembly and disassembly of such panels cannot take place without tools, so that the effort and in particular the time required for the assembly, disassembly, or replacement of panels is great.

Further, in order to provide devices with decoration or ornamentation, adhesive films that are provided with an appropriate imprint and can be stuck on walls or doors of the devices have been proposed. This produces a visual effect on a device in a simple way, but the removal or replacement of such adhesive films is difficult. In addition, adhesive films do not allow for providing the device with a relief surface or the like.

From German Application No. DE 10 2005 002 147 A1, a housing for an upright refrigeration device having a body and a door placed in position against the body is known, in which the body comprises a self-supporting inner body surrounding a heat-insulated inner space, the inner body having an open front and fastening devices arranged at the corners of the front and carrying hinges of the door, as well as an outer casing fastened to said inner body. Here, the outer casing must also be fastened to the fastening devices carrying the hinges. Such upright refrigeration devices enable an optimized assembly process without having to accept lower standards in terms of care in manufacturing.

BACKGROUND

The present disclosure aims at providing a casing for a domestic, catering, or retail sector device, such as a refrigerating device that can be attached to and removed from said device in a simple way and with little time involved. The attachment and removal of the casing preferably is possible without tools by untrained personnel. Nevertheless, the casing should be capable of being firmly connected to the device in order to achieve a solid structure and a solid appearance. In particular, the casing should be suitable for devices in the catering sector, where changing the outer appearance of devices, for example, for the purpose of changing interior design, may be required. Therefore, it should also be possible to replace the casing several times without signs of wear and tear. Further, in the catering sector, it is desirable that the device concerned is given the most various and diverse appearances by replacing the casing, for example, including a surface relief, which should also be made possible by the present disclosure.

In at least one embodiment, a casing comprises two lateral casing elements for covering the lateral walls of the device, a top casing element for covering the top wall of the device, and a rear casing element for covering the rear wall of the device, wherein the lateral casing elements and the top casing element each have an angled front edge section for engaging around the front edge of the lateral wall and the front edge of the top wall, respectively, and the lateral casing elements each carry a retaining profile on the face opposite the angled front edge section, the rear casing element being held in said retaining profiles. Thus, the present disclosure provides a set of casing elements by way of which the visible faces of any cuboid domestic or catering sector device can be cased in a simple way. For casing the door of such devices, it is preferable that a separate casing element is provided.

In at least one embodiment, the fastening of the casing elements to the walls of the device substantially occurs only by way of positive-fit connections, namely such that the lateral casing elements and the top casing element engage around the front edges of the device with their respective edge sections, wherein the rear casing element provides for holding together the lateral elements so as to create an overall continuous structure that positively embraces the device both at the front and at the back. Thus, no additional connecting elements such as screws, rivets, nails, clamps, bolts, snap-in or click-stop elements, or the like are necessary. However, the attachment of such additional connecting elements is not excluded where this appears to be necessary for increased stability of, for example, very heavy casing elements. Further, a major advantage of the design according to the present disclosure is that the device does not need to be equipped with a frame or retaining device. Thus, the device can be readily used even without casing elements without any aesthetic disadvantage.

The retaining profiles provided according to the present disclosure do not only allow holding the rear casing element in a position assigned to the rear wall of the device, but also enable the two lateral casing elements to be fixed at a defined distance from each other.

At the same time, the retaining profiles, if appropriately designed, have the advantage that the rear casing element can be spaced apart from the rear wall of the device, if required, which is advantageous in case of refrigerating devices, for example, for facilitating air circulation, considering the heat exchanger elements usually fastened to the rear wall. The rear casing element can also be provided with venting slots.

If, as this corresponds to a preferred development, the retaining profiles each have a stop surface protruding from the plane of the lateral casing element for engaging around the rear edge of the lateral walls, the device will be positively embraced by the casing both at the front and at the back.

If, as this corresponds to a preferred embodiment, the rear casing element is secured in the retaining profiles against pulling out in a direction perpendicular to the plane of the lateral casing elements, the lateral casing elements are prevented from being moved apart in a simple way. The rear casing elements can be prevented from moving apart in a particularly simple constructional way by providing that two opposite lateral edge sections of the rear casing element can be inserted in the retaining profile in a direction perpendicular to the plane of the top casing element. The insertion can preferably be achieved by providing that the retaining profile has a receiving slot with an L-shaped cross-section for receiving an appropriately angled lateral edge section of the rear casing element.

In order to improve the fastening of the lateral and the top casing element to the front of the device, it is provided in accordance with another preferred development that the angled front edge sections of the lateral casing elements and of the top casing element each have a projecting, in particular rail-shaped, retaining element for engaging a groove, depression, or recess of the device.

Basically, the top casing element cannot easily come off the top wall of the device by itself due to gravity. However, it cannot be excluded that the top casing element may shift due to outside influences, for example, when the device is transported. An improved fastening of the top casing element and in particular the attainment of a positive fit also on the rear face of the device is achieved in accordance with another preferred embodiment if the top casing element has a rear-angled edge section for engaging around the rear edge of the top wall.

If the lateral casing elements and the top casing element meet at the edges formed between the top wall and each of the two lateral walls of the device, this may result in a disadvantageous appearance and there could even be a risk of injury, in particular in case of sharp-edged casing elements. In order to avoid the casing elements meeting exactly at the edges, a preferred further development provides that the lateral casing elements have an angled top edge section for engaging around the top edge of the lateral wall, the angled top edge section being formed with an angled end section at its end facing the angled front edge section so as to form an area engaging around a corner of the device. Thus, the lateral casing elements do not only cover the lateral walls of the device, but also a section of the top wall with their angled top edge section. Here, the top casing element can be formed somewhat narrower so that it comes to rest edge to edge with the angled top edge sections of the lateral casing elements.

Alternatively, the top casing element can be arranged to overlap the angled top edge sections of the lateral casing elements so that a gap between the casing elements because of manufacturing tolerances is avoided. Said overlapping can be arranged such that the top casing element is located in the overlapping area above the angled top edge sections of the lateral casing elements. Conversely, it is also possible that the angled top edge sections of the lateral casing elements are located in the overlapping area above the top casing element, which has the advantage that the top casing element is thus secured against removal. In case of overlapping, the embodiment is preferably further developed such that the angled front edge section of the top casing element is formed to be shorter than the extension in width of said casing element in order to avoid the angled front edge section of the top casing element overlapping the angled front edge sections of the lateral edge sections which could lead to an undesired thickening at the front of the device preventing the door of the device from forming a tight seal.

As already mentioned, the door of the device preferably has a separate front casing element. A particularly stable fastening to the door of the device is achieved advantageously by providing that the front casing element has an angled edge section at each of its edges so that all front edges of the door of the device are engaged around. A further improvement of the fastening is achieved in accordance with another preferred embodiment if at least one edge section of the front casing element has at least one resilient click-stop element engaging behind the door of the device. Alternatively, to form a resilient click-stop element, it can also be provided that at least one of the angled edge sections has apertures for receiving a pin or the like, wherein the pin is fastened in a corresponding opening of the door.

In at least one simple design variant, the casing elements can preferably be formed by a metal sheet or by a plate-shaped plastic part so as to obtain a light-weight and easy-to-handle structure. Said metal sheet or plate-shaped plastic part can either itself provide the appearance determining the desired aspect of the device, wherein, for this purpose, the metal sheet can have a suitable coating, chrome plating, painting, or the like on the outside, or serve as a basis for the attachment of other separate casing and decorative elements. In the latter case, it is preferably provided that the lateral casing elements, the top casing element and, if appropriate, the front casing element each carry a decorative cover. The decorative cover can for example be formed by a plate. In particular, wooden boards, e.g., veneered wooden boards, for achieving a wooden look, boards with a textile or leather covering, glass plates, plates with or made of a concrete layer, or a concrete-like layer are conceivable. The decorative covers can be connected to the metal sheet by any means, for example, stuck, clipped, clamped, screwed, or riveted thereon.

DESCRIPTION OF THE DRAWING

The present disclosure will hereinafter be explained in more detail with reference to an exemplary embodiment schematically illustrated in the drawing, in which.

DETAILED DESCRIPTION

Figure 1:
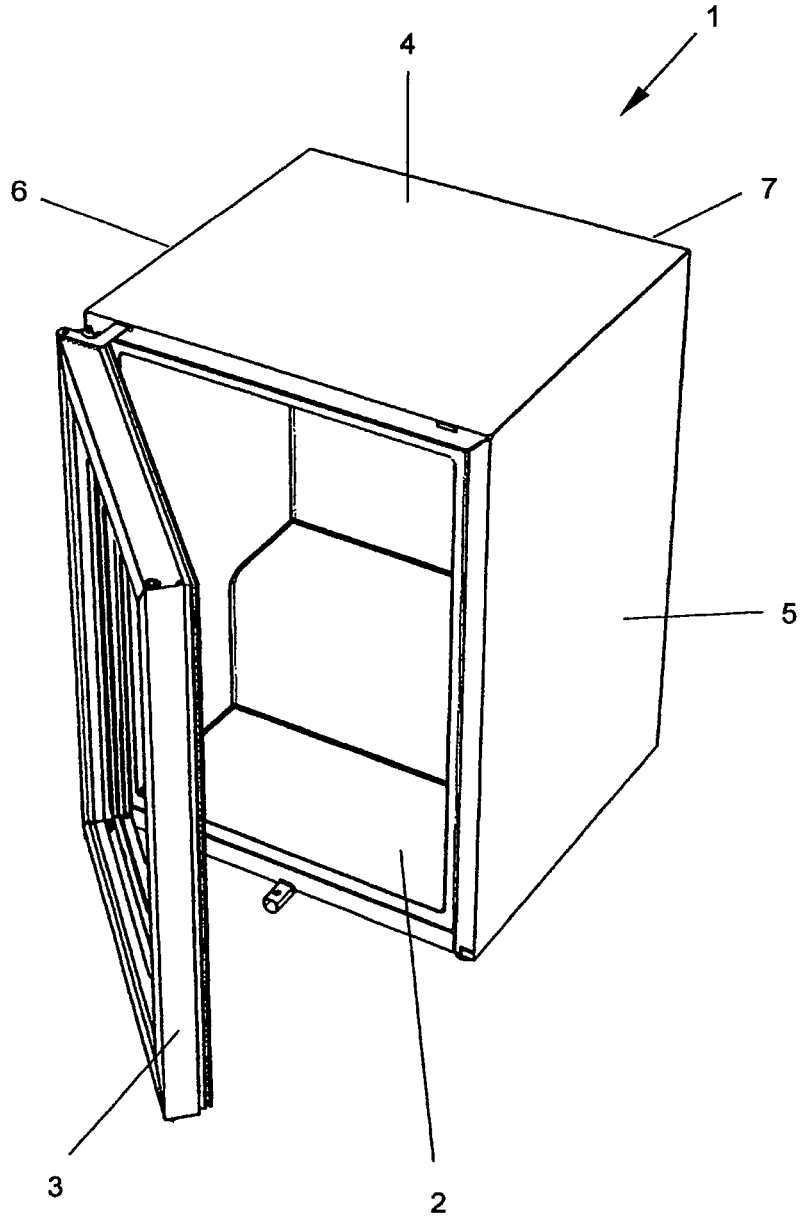
FIG. 1 shows a refrigerating device.

FIG. 1 shows a refrigerating device 1, a coolable inner space 2 that is accessible through a pivotable door 3 of the device. The refrigerating device has a top wall 4, two lateral walls 5 and 6, and a rear wall 7. The dimensions of the refrigerating device 1 can, in principle, be freely chosen. In particular, the device is a refrigerator for use in the catering sector as it is usually suitable for receiving beverages, in particular beverage cans, and for installation on a bar, counter, or the like.

Figure 2:
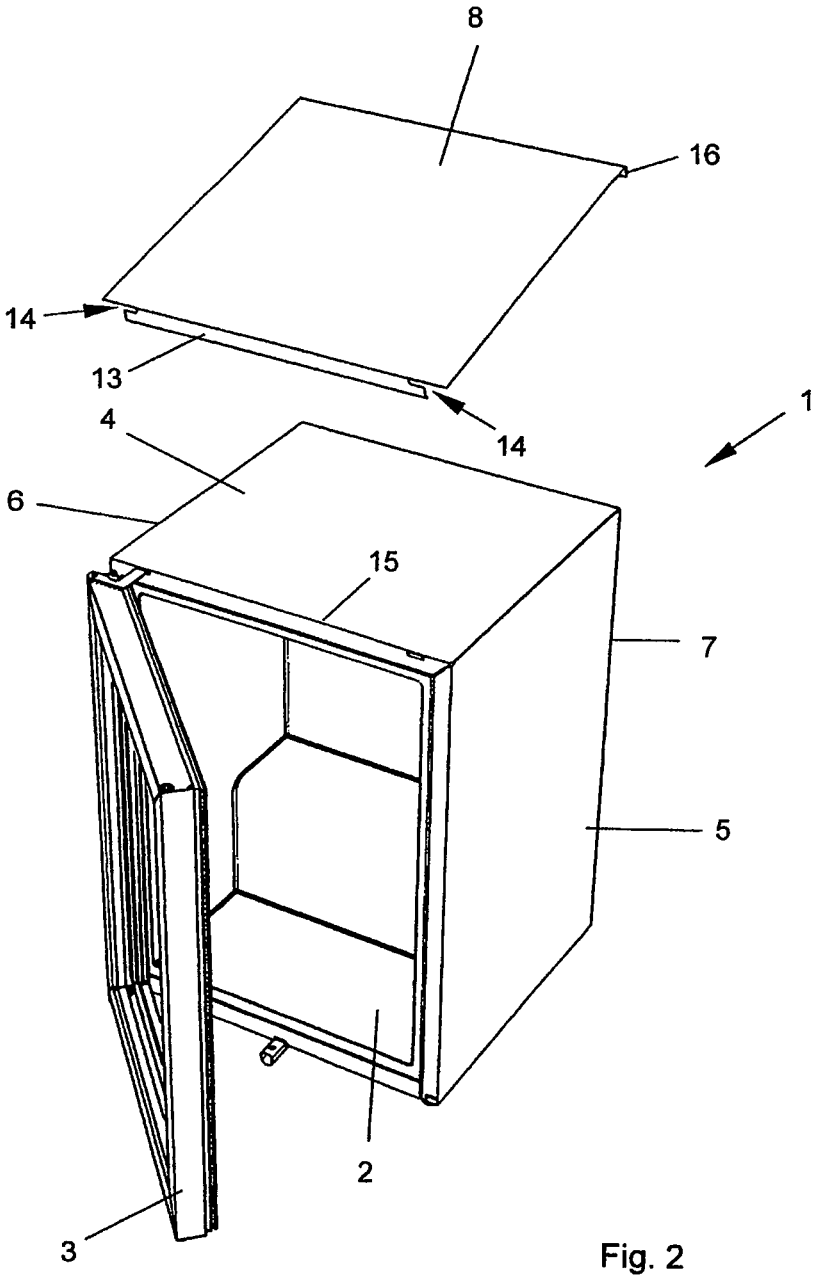
FIGS. 2 and 3 show the attachment of the top casing element.
Figure 3:
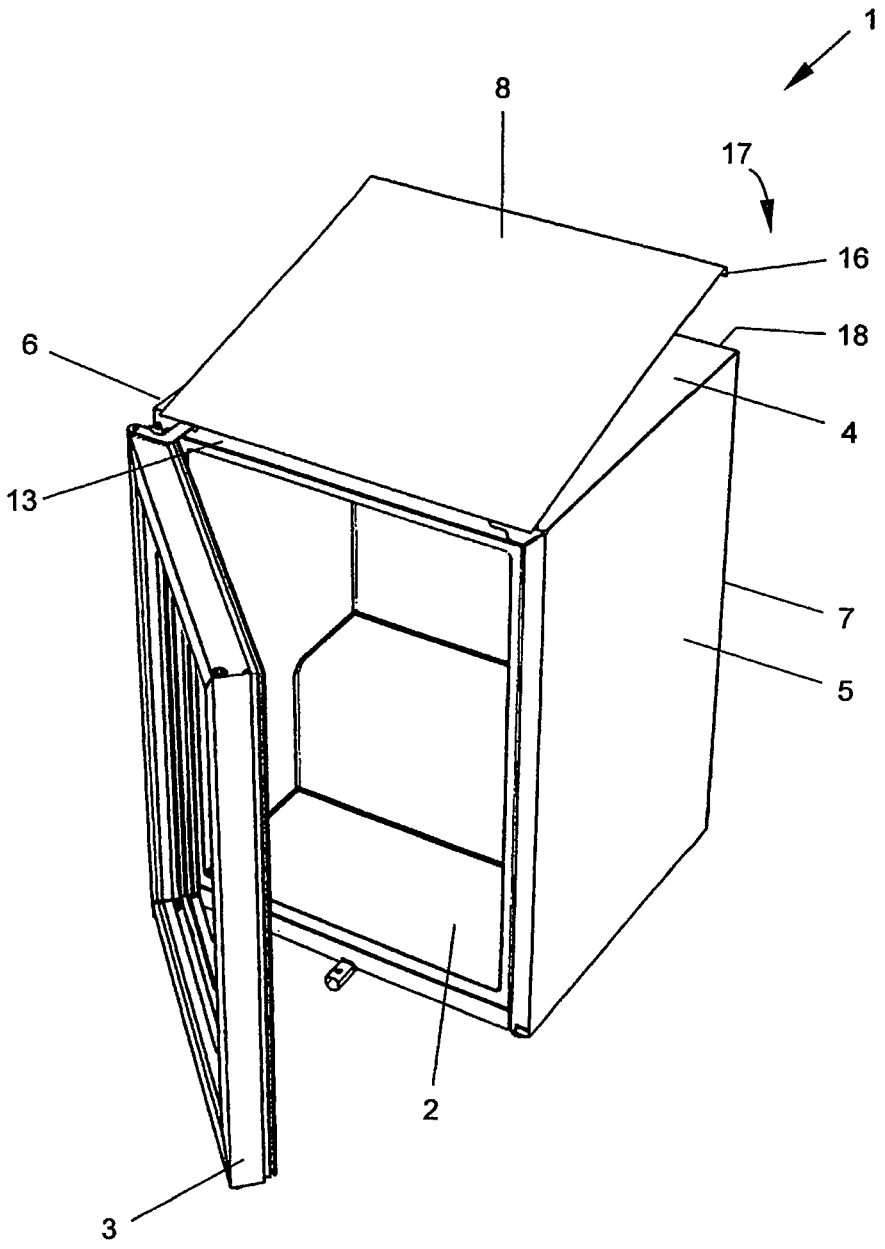
Figure 4:
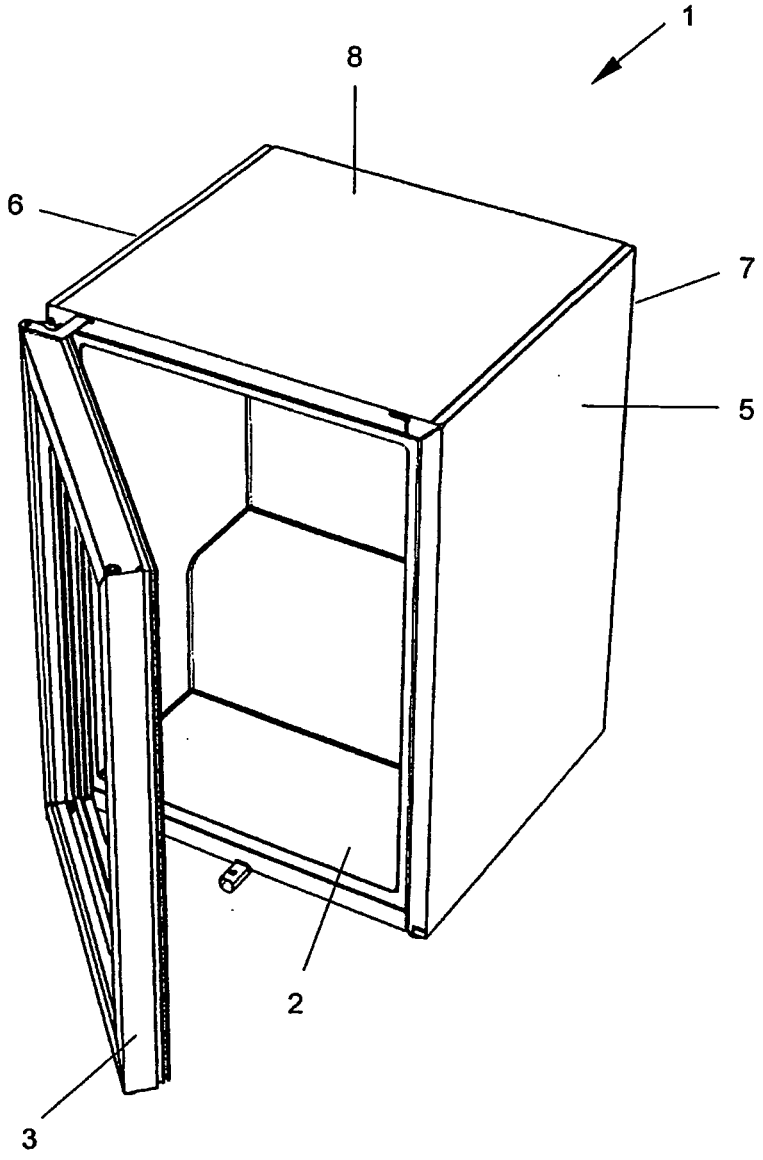
FIG. 4 shows the refrigerating device after the attachment of the top casing element.
Figure 5:
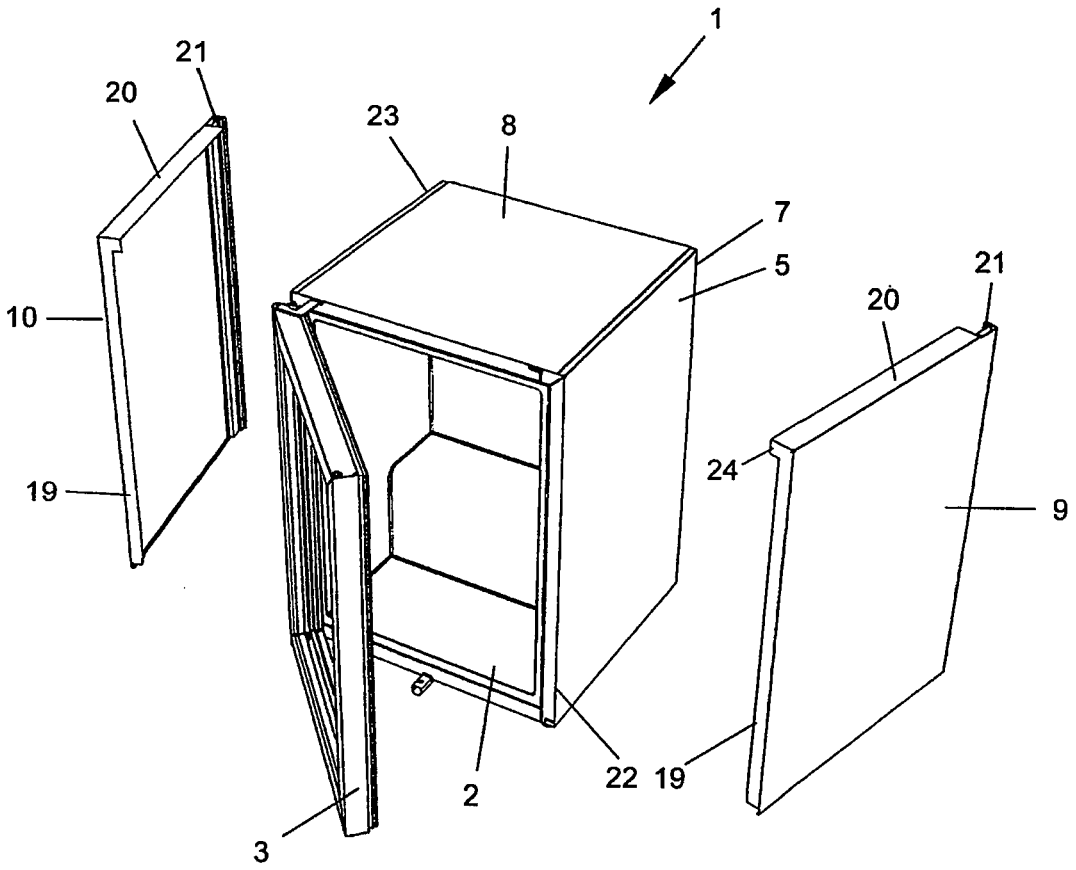
FIGS. 5 and 6 show the attachment of the lateral casing elements.
Figure 6:
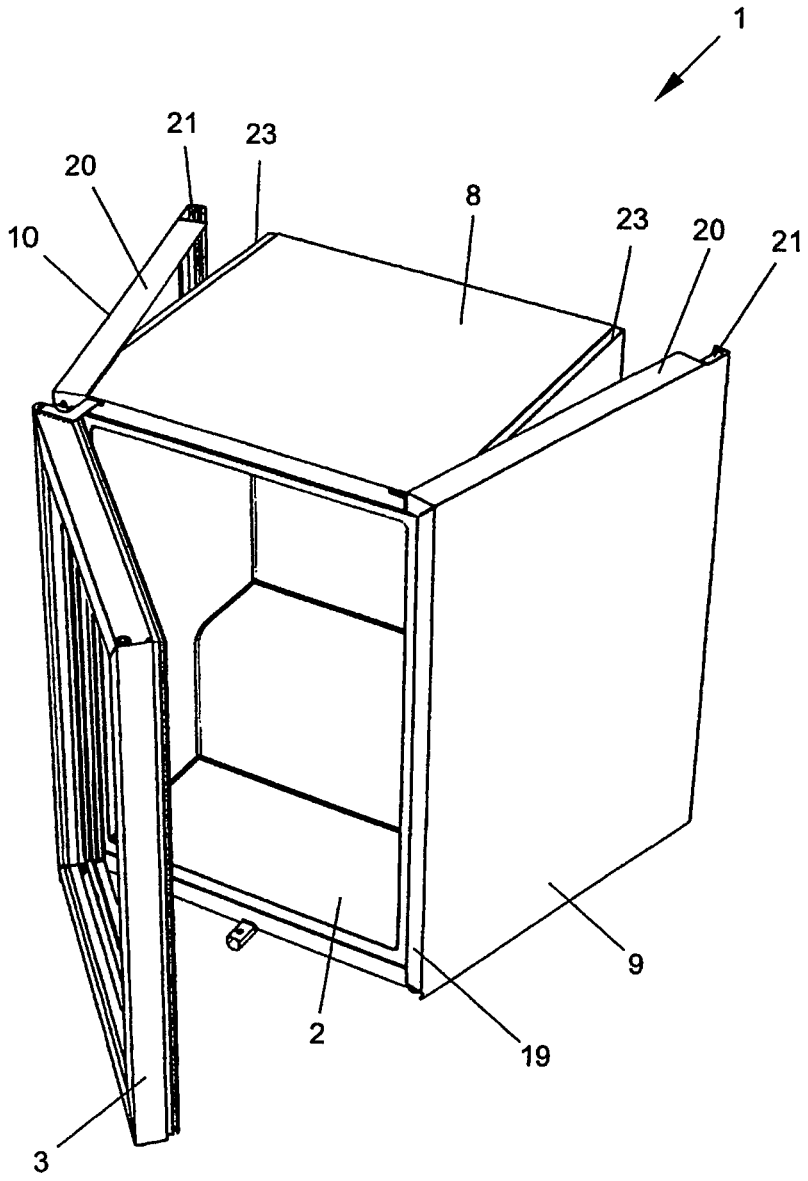
Figure 7:
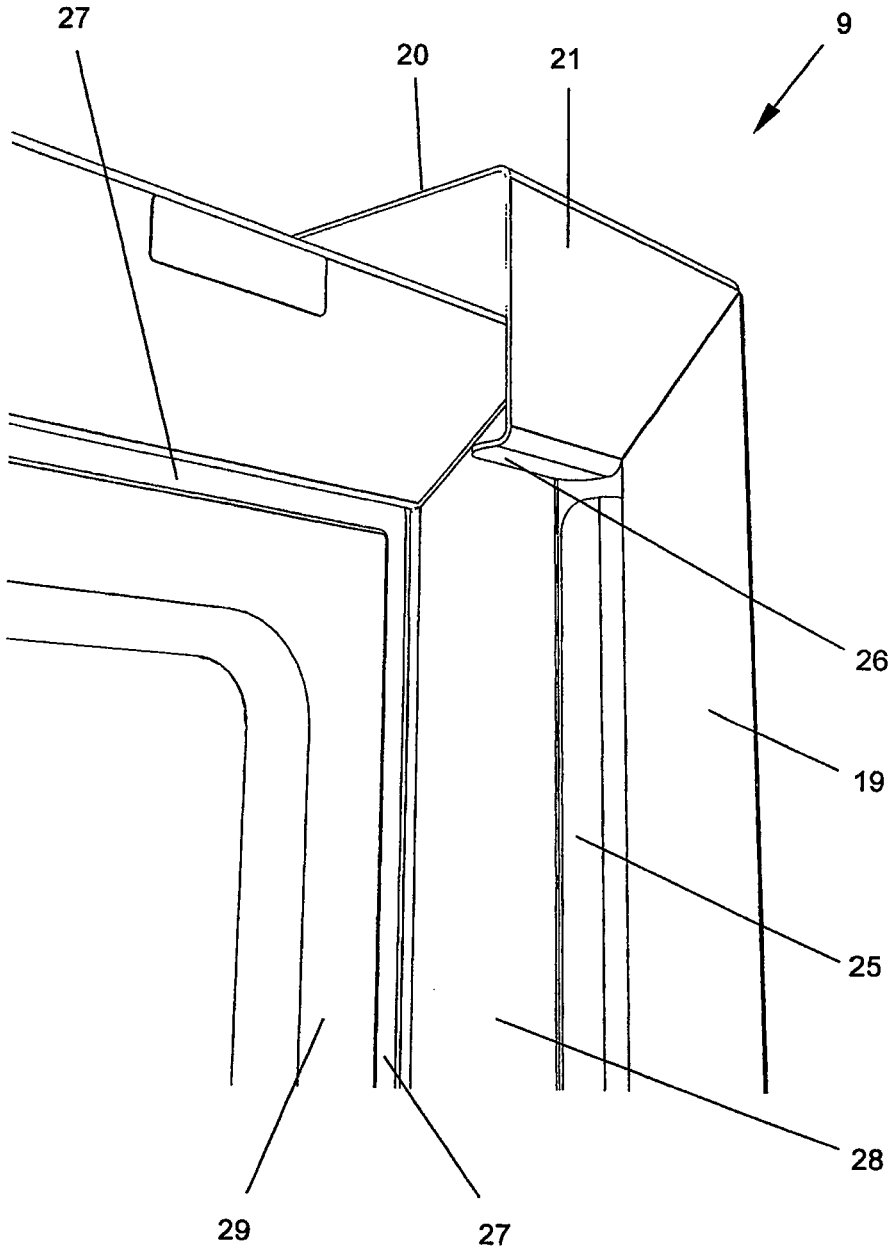
FIG. 7 shows a detailed view of the fastening of the lateral casing elements on the refrigerating device.

In the present exemplary embodiment, the casing of the refrigerating device consists of a top casing element 8, two lateral casing elements 9 and 10, a rear casing element 11, and a front casing element 12. FIGS. 2 and 3 illustrate how the top casing element 8 is attached to the refrigerating device 1. The top casing element 8 has an angled front edge section 13 which can engage around a front edge 15 of the refrigerating device. The front edge section 13 is inserted by its rail-shaped retaining element, the function of which will be explained in more detail below with reference to the equivalent design of the lateral casing elements in FIG. 7, in an oblong gap formed at the front of the refrigerating device, whereupon the front edge section 13 is pivoted onto the top wall 4 according to arrow 17, so that an angled rear edge section 16 of the top casing element engages around a rear edge 18 of the top wall 4 and the state illustrated in FIG. 4 is achieved. It is also apparent from FIG. 2 that the angled front edge section 13 has two slot-like recesses 14 for the hinge of the door 3 of the device. Depending on whether the door 3 of the device is mounted left or right hinged, the hinge is inserted in the left or the right recess 14.

In a similar way, the two lateral casing elements 9 and 10 are assembled. Again, the lateral casing elements 9 and 10 each have an angled front edge section 19 for engaging around a front edge 22, and an angled top edge section 20 for engaging around a top edge 23. Said angled top edge section has an angled end section 24 that is located in the same plane as the angled front edge section 19 and forms a corner with the latter. For fastening the angled front edge section 19 and the end section 24 to the front of the refrigerating device, they each have a protruding retaining element 25 and 26, which is again formed by an angle and is inserted into a gap 27 formed between a housing part 28 and an inner lining 29 of the refrigerating device 1.

Figure 8:
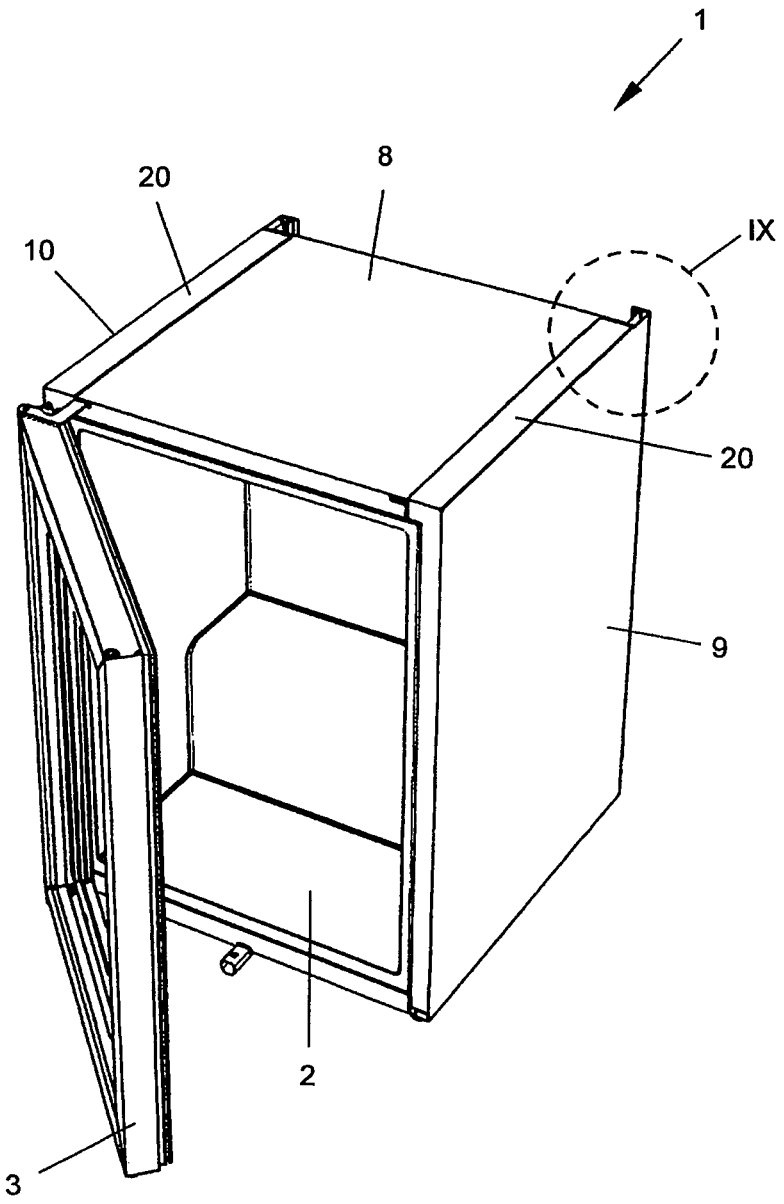
FIG. 8 shows the refrigerating device after attachment of the lateral casing elements.

FIG. 8 shows the state after attachment of the lateral casing elements 9 and 10. Here, the angled top edge sections 20 overlap the top casing element 8 so that the latter is secured against removal. However, it would also be possible in principle to first assemble the lateral casing elements 9 and 10 and only then add the top casing element 8; in this case, however, the latter would not be secured against removal without additional measures.

Figure 9:
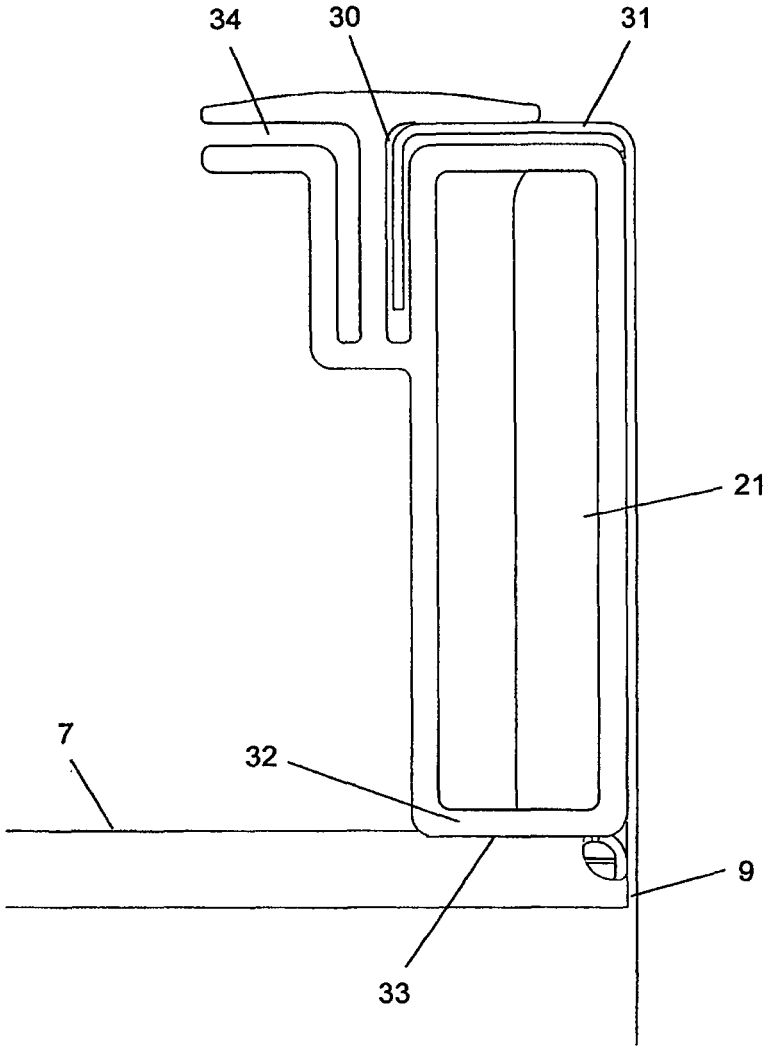
FIG. 9 shows a detailed view of the area IX of FIG. 8.

It is apparent from the detailed view in accordance with FIG. 9 that the lateral casing element 9 carries a retaining profile 21. For its connection to the lateral casing element 9, the retaining profile 21 has an L-shaped slot 30 in which a double-bent end section 31 of the lateral casing element 9 is inserted. Further, with its area 32, the retaining profile 21 has a stop surface 33 protruding from the plane of the lateral casing element 9, with which it rests against the rear wall 7 of the refrigerating device 1 so that the lateral casing element 9 embraces the refrigerating device 1 both at the front, namely with the angled front edge section 19, and at the back, namely with the retaining profile 21.

Figure 10:
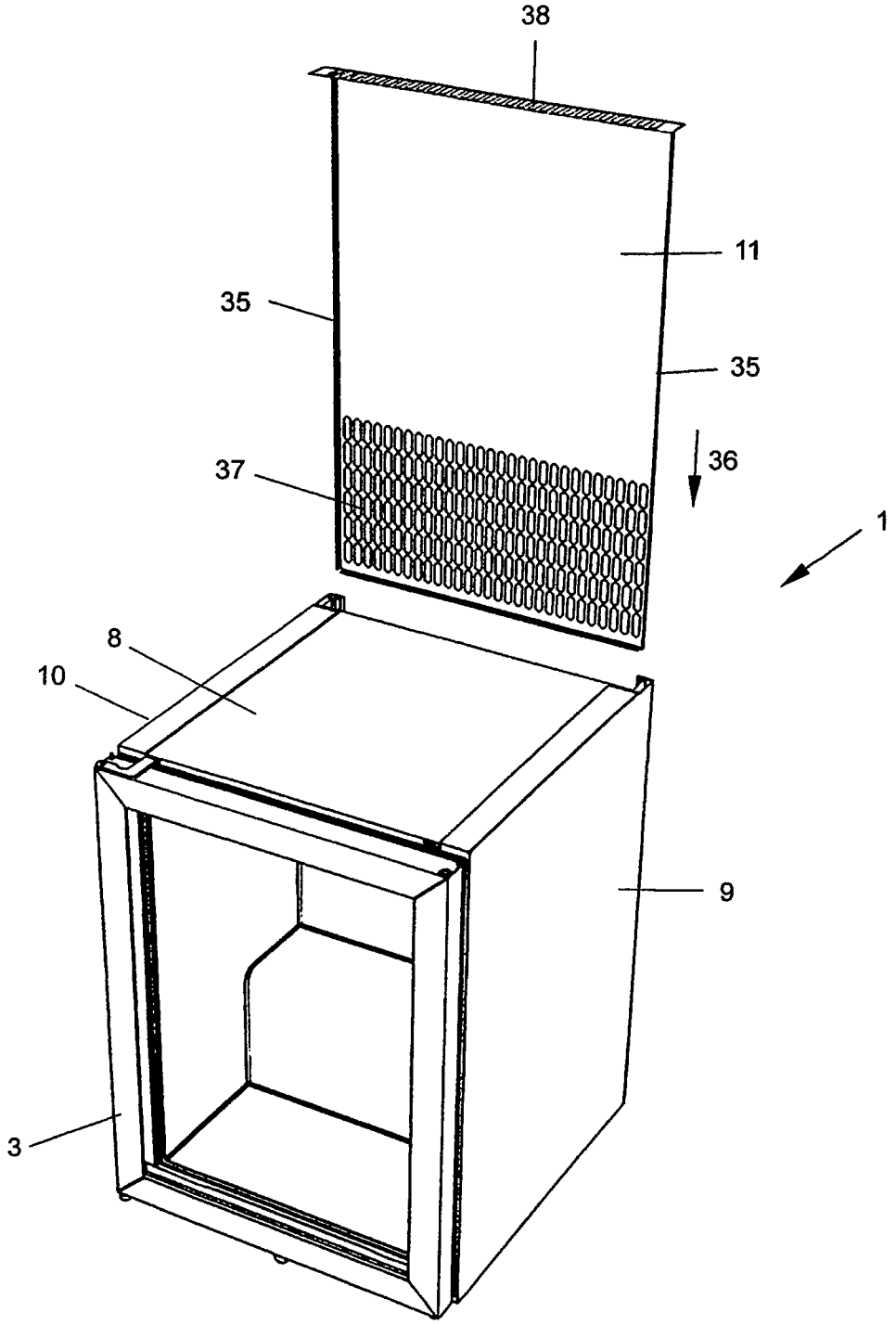
FIG. 10 shows the attachment of the rear casing element.
Figure 11:
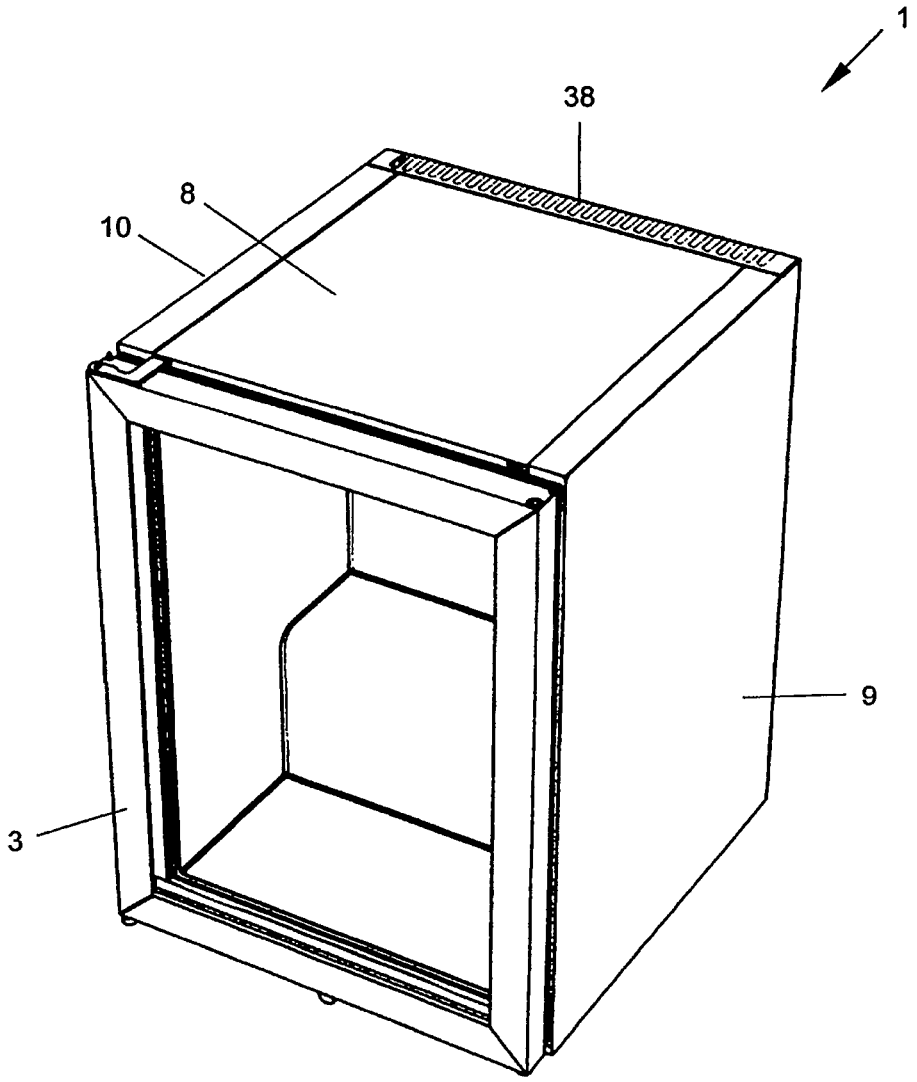
FIG. 11 shows the refrigerating device after attachment of the rear casing element.

For fastening the rear casing element 11, the retaining profile 21 has a further L-shaped receiving slot 34 which is formed to be symmetrical with respect to the slot 30. The receiving slot 34 serves to receive an angled edge section 35 of the rear casing element 11, the two edge sections 35 being inserted into the retaining profiles 21 from above in the direction of arrow 36, as shown in FIG. 10. Said receiving slots 34 are arranged such that a gap remains between the rear wall 7 and the rear casing element 11 so that air circulation is made possible. Venting slots are referred to by numeral 37. A horizontally angled section 38 of the rear casing element 11 also has venting slots. As can be seen from FIG. 11, the horizontal angled section 38 is flush with the top casing element 8.

Figure 12:
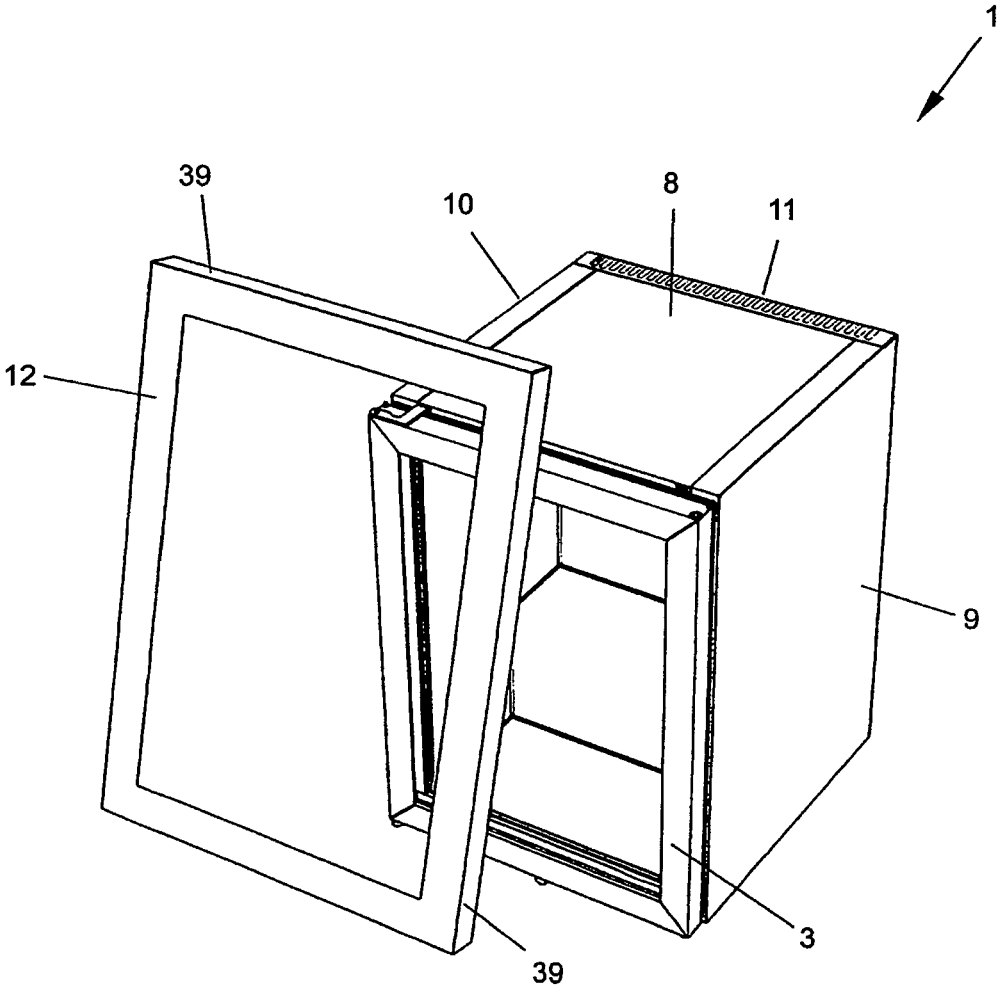
FIGS. 12 and 13 show the attachment of the front casing element on the door of the device.
Figure 13:
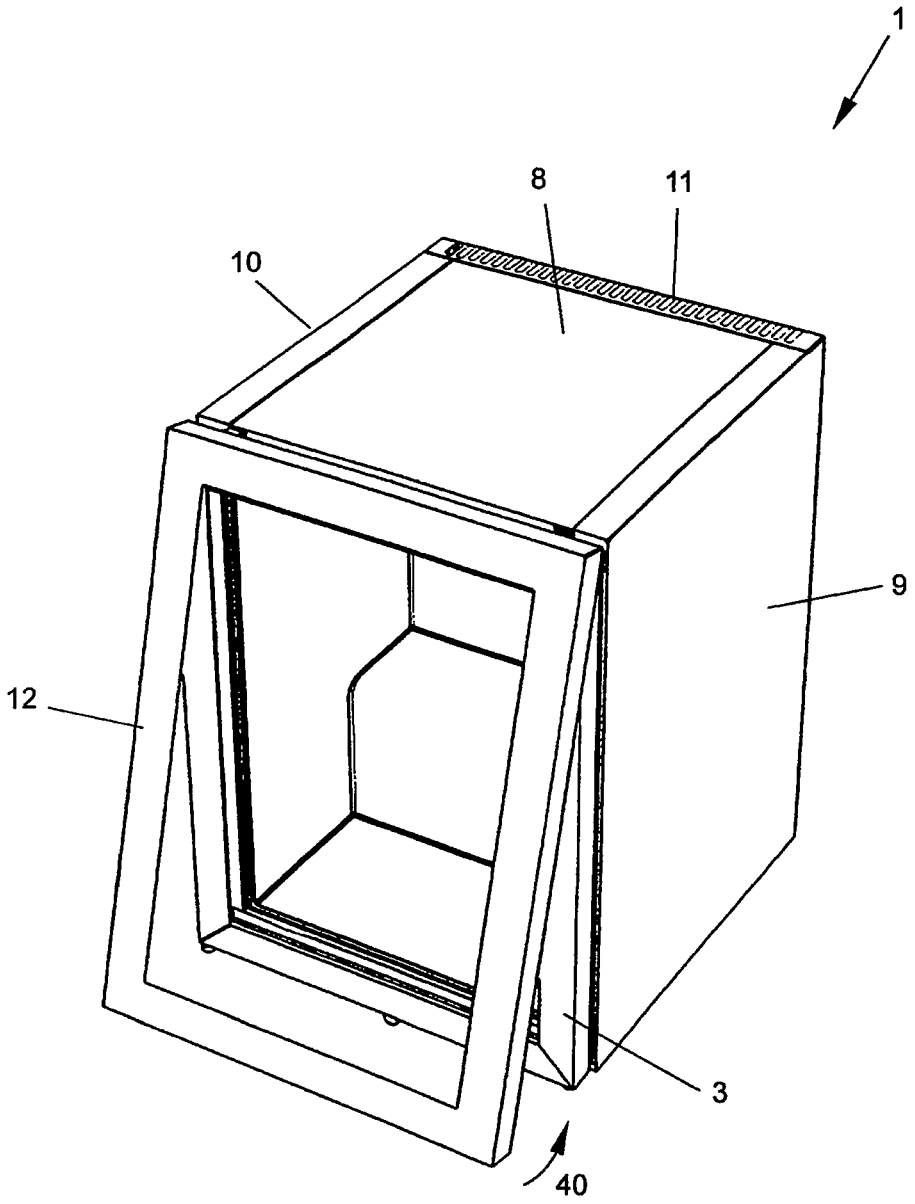
Figure 14:
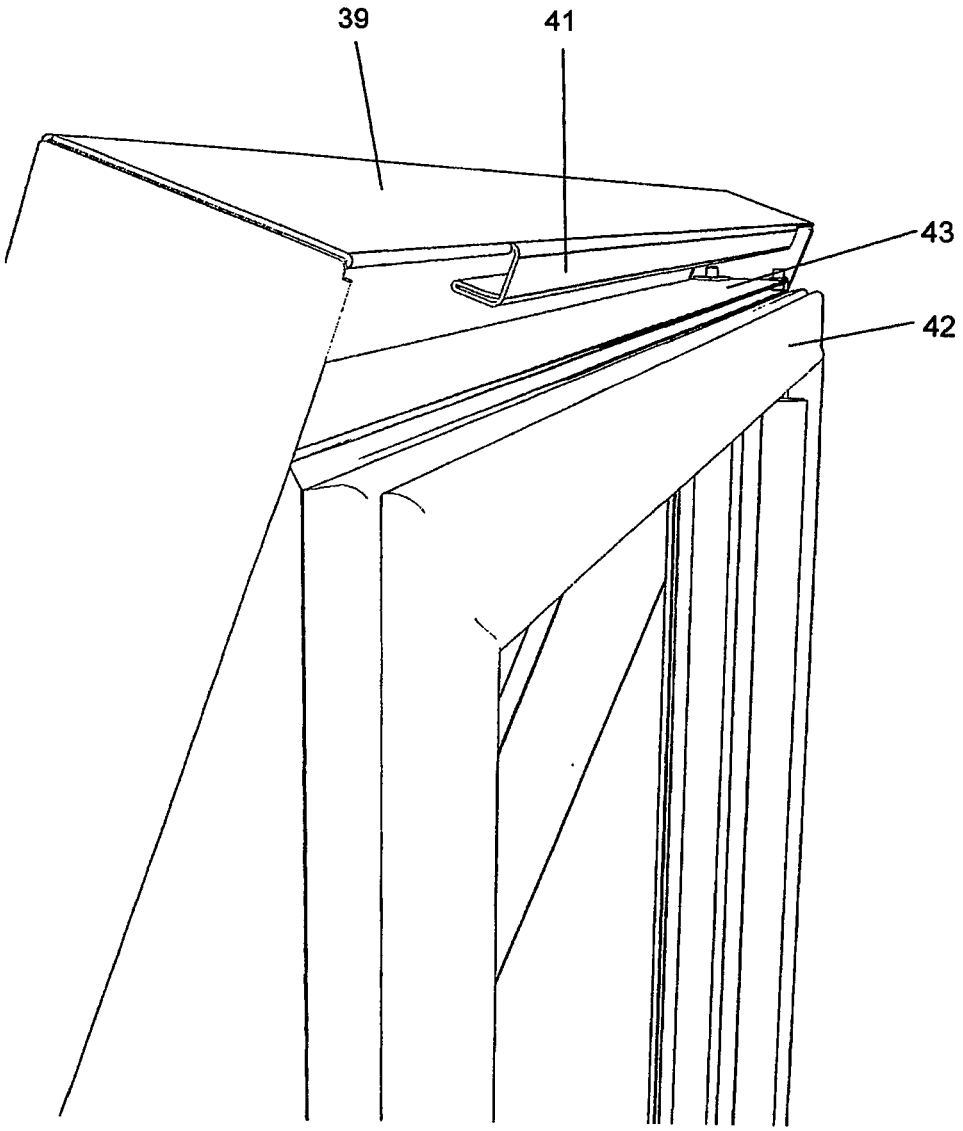
FIGS. 14 and 15 show a detailed view of the door of the device from the inside.
Figure 15:
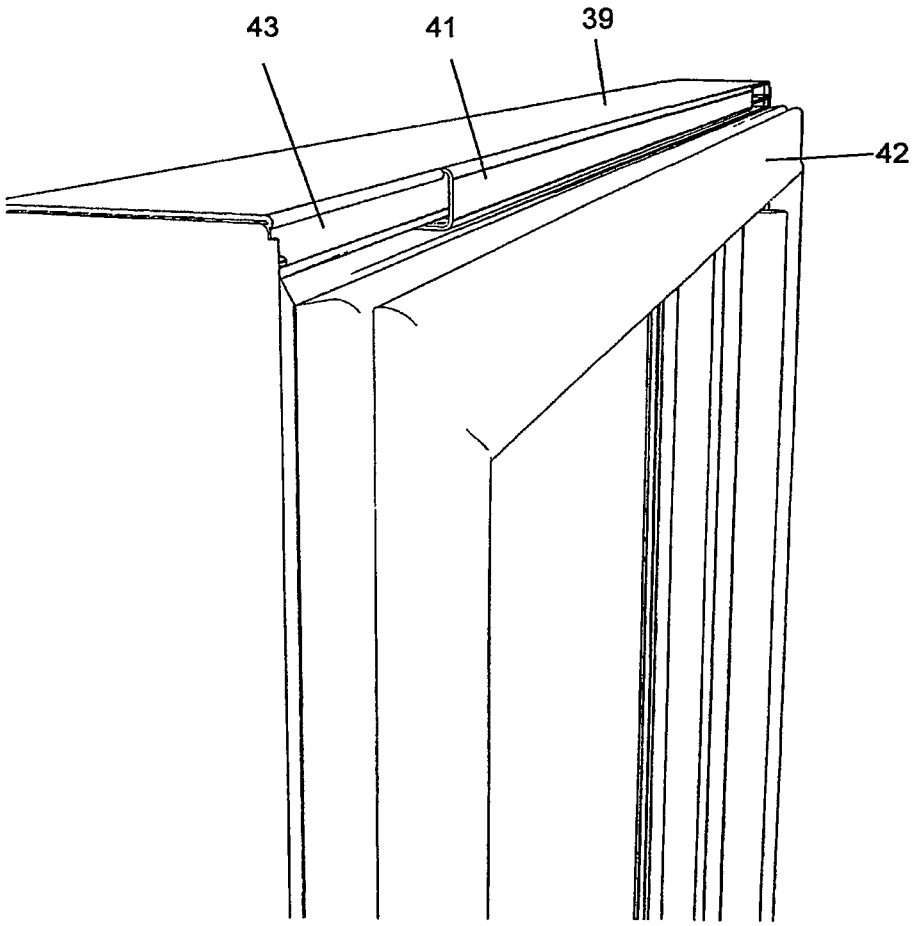

The attachment of the front casing element 12 is illustrated in FIGS. 12 and 13. The front casing element 12 is formed to be frame-like and has angled edge sections 39 on all four sides that engage around the edges of the door 3 of the device. The front casing element 12 is first put onto the top edge of the door 3 and is then pivoted onto the door 3 of the device according to arrow 40 so as to obtain a completely cased refrigerating device 1 as illustrated in FIG. 15. From the detailed view in accordance with FIG. 14, it is apparent that the top edge section 39 of the front casing element 12 has at least one L-shaped shoulder 41 that can be inserted in a slot provided on the inside of the door 3 of the device. Said slot is located between the door frame referred to as 43 and the inner casing 42 of the door 3 carrying the circumferential seal 42. In order to facilitate the insertion of the one leg of the L-shaped shoulder 41 in the slot, the shoulder 41 is formed to be resilient. The assembled state is illustrated in FIG. 15.

Figure 16:
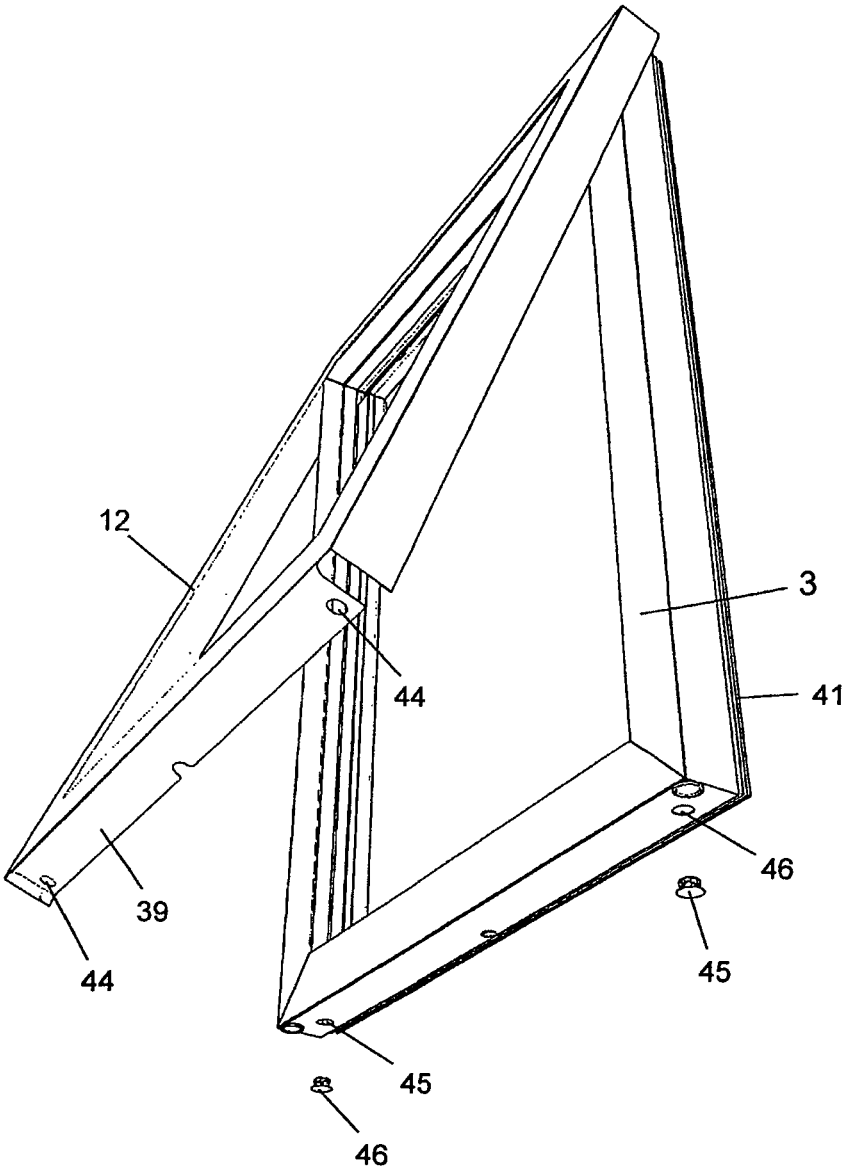
FIG. 16 shows a detailed view of the door of the device from below.
Figure 17:
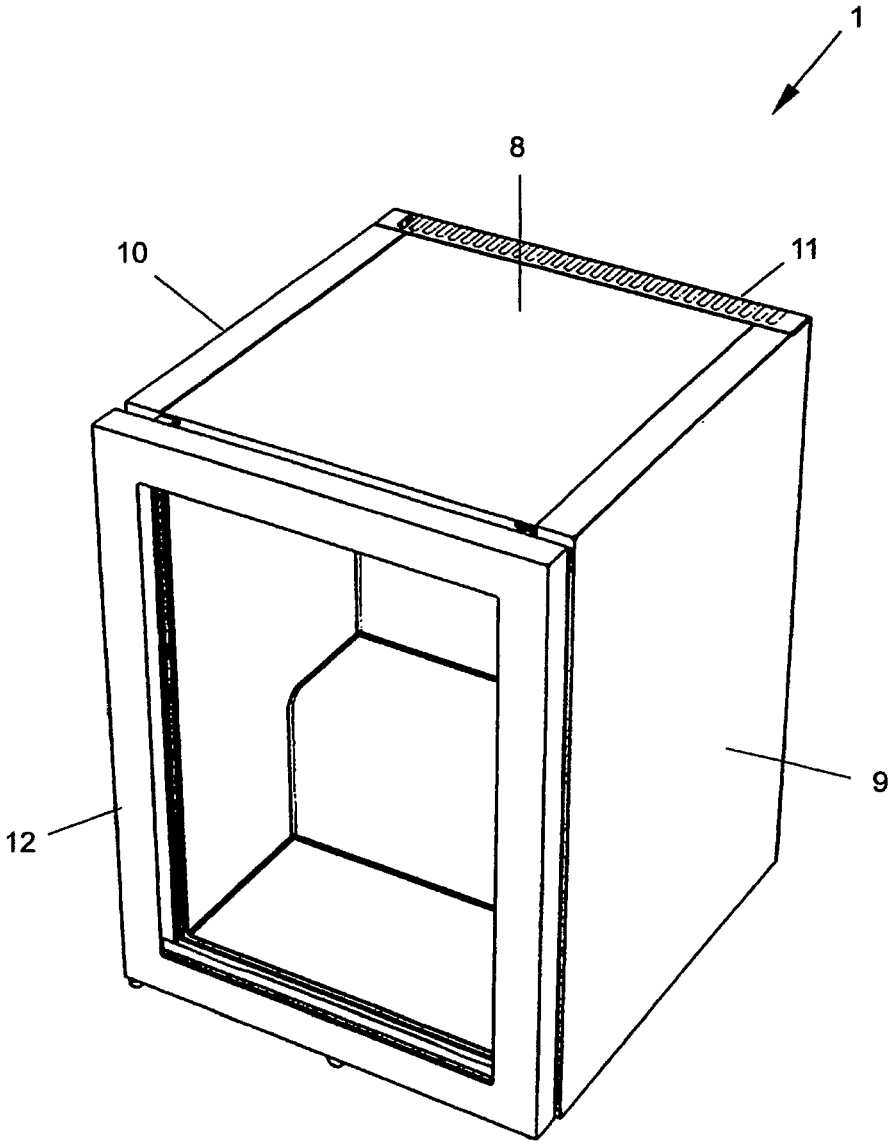
FIG. 17 shows the refrigerating device after attachment of all casing elements.

The lower edge section 39 of casing element 12 as apparent from FIG. 16 has two apertures 44 that align with recesses 45 of the door 3 of the device in the assembled state. Here, the assembly of the casing element 12 comprises inserting pins 46 into the apertures 44 and the recesses 45 so that the casing element 12 is fixed to the door 3.

From the above description of the assembly of the casing elements, it is apparent that the assembly is possible without tools.

The features of the present disclosure as disclosed in the above description, in the claims and in the drawings can be essential to the realization of the present disclosure in its different embodiments both individually and in any possible combination.

The invention claimed is:

1. A casing for a device that has two lateral walls, a top wall, and a rear wall, the casing comprising:

two lateral casing elements for covering the lateral walls of the device;

a top casing element for covering the top wall of the device, wherein the lateral casing elements and the top casing element each have an angled front edge section for engaging around a front edge of the lateral walls and a front edge of the top wall respectively;

a rear casing element for covering the rear wall of the device; and a retaining profile on a rear edge section of each of the lateral casing elements opposite the angled front edge section, wherein lateral edge sections of the rear casing element are held in the respective retaining profiles, and wherein each of the retaining profiles has a receiving slot for receiving a respective lateral edge section of the rear casing element, wherein the lateral casing elements, the top casing element, and the rear casing element hold together without using screws, rivets, or the like.

2. The casing according to claim 1, wherein the rear casing element is secured in the retaining profiles against pulling out in a direction perpendicular to a plane of the lateral casing elements.

3. The casing according to claim 1, wherein two opposite lateral edge sections of the rear casing element are insertable into the retaining profile in a direction perpendicular to a plane of the top casing element.

4. The casing according to claim 1, wherein the receiving slot of each of the retaining profiles has an L-shaped cross section for receiving an appropriately angled lateral edge section of the rear casing element.

5. The casing according to claim 1, wherein the retaining profiles each include a stop surface protruding from a plane of the lateral casing element for engaging around a rear edge of the lateral walls.

6. The casing according to claim 1, wherein the angled front edge sections of the lateral casing elements and of the top casing element each include a projecting retaining element for engaging a groove, depression, or recess of the device.

7. The casing according to claim 6, wherein the projecting retaining element is rail-shaped.

8. The casing according to claim 1, wherein the top casing element has a rear-angled edge section for engaging around a rear edge of the top wall.

9. The casing according to claim 1, wherein the lateral casing elements have an angled top edge section for engaging around a top edge of the lateral walls, wherein the angled top edge section is formed with an angled end section at its end facing the angled front edge section so as to form an area engaging around a corner of the device.

10. The casing according to claim 9, wherein the angled front edge section of the top casing element is formed to be shorter than an extension in width of said casing element.

11. The casing according to claim 1, further comprising a front casing element for covering a door of the device.

12. The casing according to claim 11, wherein the front casing element has an angled edge section at each of its edges.

13. The casing according to claim 11, wherein at least one edge section of the front casing element has at least one resilient click-stop element engaging behind the door of the device.

14. The casing according to claim 1, wherein the casing elements are each formed by a metal sheet or a plate-shaped plastic part.

15. The casing according to claim 1, wherein the rear casing element has venting slots.

16. The casing according to claim 1, wherein the lateral casing elements and the top casing element each carry a decorative cover.

17. The casing according to claim 16, wherein the decorative cover is formed by a plate.

18. The casing according to claim 16, wherein the decorative covers of the casing elements are adjacent to each other in the assembled state of the casing.

19. The casing according to claim 16, further comprising a front casing element that carries a decorative cover.

20. A device that can be used in the domestic, catering, or retail sector having a casing according to claim 1.

21. Use of the casing according to claim 1 for the replaceable casing of devices used in the domestic, catering, or retail sector.

22. The casing according to claim 1, wherein the device is a refrigerating device.

23. A casing for a device that has two lateral walls, a top wall, and a rear wall, the casing comprising:

two lateral casing elements for covering the lateral walls of the device;

a top casing element for covering the top wall of the device, wherein the lateral casing elements and the top casing element each have an angled front edge section for engaging around a front edge of the lateral walls and a front edge of the top wall respectively;

a front casing element for covering a door of the device, wherein at least one edge section of the front casing element has at least one resilient click-stop element engaging behind the door of the device;

a rear casing element for covering the rear wall of the device; and a retaining profile on a rear edge section of each of the lateral casing elements opposite the angled front edge section, wherein lateral edge sections of the rear casing element are held in the respective retaining profiles, and wherein each of the retaining profiles has a receiving slot for receiving a respective lateral edge section of the rear casing element.

24. A casing for a device that has two lateral walls, a top wall, and a rear wall, the casing comprising:

two lateral casing elements for covering the lateral walls of the device;

a top casing element for covering the top wall of the device, wherein the lateral casing elements and the top casing element each have an angled front edge section for engaging around a front edge of the lateral walls and a front edge of the top wall respectively, and wherein the top casing element has a rear-angled edge section for engaging around a rear edge of the top wall;

a rear casing element for covering the rear wall of the device; and a retaining profile on a rear edge section of each of the lateral casing elements opposite the angled front edge section, wherein lateral edge sections of the rear casing element are held in the respective retaining profiles, and wherein each of the retaining profiles has a receiving slot for receiving a respective lateral edge section of the rear casing element.

* * * * *